US007918097B2

(12) United States Patent
Kim et al.

(10) Patent No.: US 7,918,097 B2
(45) Date of Patent: Apr. 5, 2011

(54) AIR CONDITIONING SYSTEM

(75) Inventors: Bum Suk Kim, Changwon-si (KR); Man Ho Chun, Changwon-si (KR)

(73) Assignee: LG Electronics Inc., Seoul (KR)

( * ) Notice: Subject to any disclaimer, the term of this patent is extended or adjusted under 35 U.S.C. 154(b) by 413 days.

(21) Appl. No.: 12/213,111

(22) Filed: Jun. 13, 2008

(65) Prior Publication Data

US 2009/0158764 A1 Jun. 25, 2009

(30) Foreign Application Priority Data

Dec. 24, 2007 (KR) ..... 10-2007-0136786

(51) Int. Cl.
*F25B 41/04* (2006.01)
*F25B 49/00* (2006.01)
*F25B 1/10* (2006.01)

(52) U.S. Cl. ..... 62/196.1; 62/225; 62/510

(58) Field of Classification Search ..... 62/196.1, 62/197, 217, 222, 225, 510
See application file for complete search history.

(56) References Cited

U.S. PATENT DOCUMENTS

| | | | | |
|---|---|---|---|---|
| 5,943,879 | A * | 8/1999 | Sada et al. | 62/430 |
| 2007/0151266 | A1 | 7/2007 | Yakumaru et al. | |
| 2007/0266719 | A1 * | 11/2007 | Kang et al. | 62/228.5 |
| 2009/0165482 | A1 * | 7/2009 | Ko et al. | 62/222 |
| 2009/0188265 | A1 * | 7/2009 | Ko et al. | 62/222 |

FOREIGN PATENT DOCUMENTS

| | | |
|---|---|---|
| CN | 1358973 | 7/2002 |
| DE | 197 02 097 | 7/1997 |
| EP | 1 207 359 | 5/2002 |
| JP | 10-318613 | 12/1998 |
| WO | WO 2006/132632 | 12/2006 |
| WO | WO 2007/094618 | 8/2007 |

* cited by examiner

*Primary Examiner* — Marc E Norman
(74) *Attorney, Agent, or Firm* — McKenna Long & Aldridge LLP

(57) ABSTRACT

An air conditioning system is able to decrease the amount of refrigerant between a first expansion device and an injection valve and thus adjust the pressure of an injected refrigerant by decreasing the opening degree of the first expansion device and maintaining the opening degree of a second expansion device upon opening of the injection valve, thereby making the system stable upon opening of the injection valve. Furthermore, upon starting up a compressor, the opening degrees of the first and second expansion devices are partly decreased based on the start-up of the compressor and then gradually opened again, and upon completion of the start-up of the compressor, the opening amounts of the first and second expansion devices and the injection valve are controlled, thereby making the cycle more stable.

19 Claims, 10 Drawing Sheets

AIR CONDITIONING SYSTEM

This nonprovisional application claims priority under 35 U.S.C. §119(a) on Patent Application No. 10-2007-0136786 filed in Republic of Korea on Dec. 24, 2007, the entire contents of which are hereby incorporated by reference.

BACKGROUND OF THE INVENTION

1. Field of the Invention

The present invention relates to an air conditioning system, and more particularly, to an air conditioning system, which can improve the performance and stability of the system.

2. Discussion of the Related Art

Generally, an air conditioning system is an apparatus which cools or heats indoor spaces by compressing, condensing, expanding, and evaporating a refrigerant.

The air conditioning systems are classified into a normal air conditioner including an outdoor unit and an indoor unit connected to the outdoor unit and a multi-type air conditioner including an outdoor unit and a plurality of indoor units connected to the outdoor unit. Moreover, the air conditioning systems are classified into a cooling air conditioner supplying a cool air only to an indoor space by driving a refrigerant cycle in one direction only and a cooling and heating air conditioner supplying a cool or hot air to an indoor space by driving a refrigerant cycle selectively and bi-directionally.

The air conditioning system includes a compressor, a condenser, an expansion valve, and an evaporator. The refrigerant discharged from the compressor is condensed in the condenser, and then expands in the expansion valve. The expanded refrigerant is evaporated in the evaporator, and then sucked into the compressor. IN a cooling operation or heating operation, a gaseous refrigerant is injected into the compressor, thus improving performance.

However, the air conditioning system according to the conventional art has the problem that the system may become unstable and damage may occur to the compressor or the like if not controlled properly.

SUMMARY OF THE INVENTION

It is an object of the present invention to provide an air conditioning system, which can improve the performance and stability of the system.

The present invention provides an air conditioning system, comprising: a condenser for condensing a refrigerant; a first expansion device for throttling the refrigerant passed through the condenser; a second expansion device for throttling the refrigerant passed through the first expansion device; an evaporator for evaporating the refrigerant passed through the second expansion device; a compressor for introducing and compressing the refrigerant passed through the evaporator and the refrigerant branched and injected between the first expansion device and the second expansion device; an injection valve for adjusting the amount of refrigerant branched between the first expansion device and the second expansion device and injected into the compressor; and a control unit for controlling so as to decrease an opening degree of the first expansion device for a set period of time before and after the opening of the injection valve and maintain an opening degree of the second expansion device.

In the present invention, upon opening of the injection valve, the control unit controls so that a change in the opening degree of the injection valve may change until the opening degree of the injection valve reaches a target opening degree.

Furthermore, in the present invention, upon opening of the injection valve, the control unit may repeat a change process of changing an opening degree of the injection valve until the opening degree of the injection valve reaches a target opening degree and a maintenance process of maintaining the opening degree.

In the present invention, the control unit fully opens the first and second expansion devices before current is applied to the air conditioning system and the compressor is started.

In the present invention, upon start-up of the compressor, if the air conditioning system is in a heating operation mode, the control unit decreases opening degrees of the first and second expansion devices, and then increases the opening degrees of the first and second expansion devices so as to reach respective preset basic opening degrees. The control unit may repeat a change process of changing the opening degrees of the first and second expansion devices until the opening degrees of the first and second expansion devices reach respective preset basic opening degrees and a maintenance process of maintaining the opening degrees.

In the present invention, upon start-up of the compressor, if the air conditioning system is in a cooling operation mode, the control unit maintains an opening degree of the first expansion device, decreases an opening degree of the second expansion device, and then increases the opening degree of the second expansion device so as to reach a preset basic opening degree. The control unit may repeat a change process of changing the opening degree of the second expansion device until the opening degree of the second expansion device reach a preset basic opening degree and a maintenance process of maintaining the opening degree.

In the present invention, when the opening degree of the injection valve reaches a target opening degree, the control unit controls an opening amount of the first expansion device in an intermediate pressure control method for adjusting an intermediate pressure of refrigerant, and in the intermediate pressure control method, a value of at least one of operating parameters is detected, and the opening amount of the first expansion device is controlled based on a stored set value corresponding to the detected value of the operating parameter.

In the present invention, if the value of the operating parameter is out of a preset normal operating range, the control unit controls the first expansion device by switching to a safety control method, which is different from the intermediate pressure control method. The operating parameters include a discharge temperature of refrigerant discharged from the compressor and a temperature of refrigerant passed through the condenser. If a value of at least one of the operating parameters is out of the normal operating range, the first expansion device is controlled by switching to a safety control method, which is different from the intermediate pressure control method. In the safety control method, a preset correction opening degree is combined with the opening degree of the first expansion device stored upon switching from the intermediate pressure control method to thus control the opening amount of the first expansion device.

In the present invention, when the opening degree of the injection valve reaches a target opening degree, the control unit controls the second expansion device in a superheat degree control method for adjusting the degree of superheat of refrigerant, and in the superheat degree control method, the degree of superheat of refrigerant is measured in real time, and the opening amount of the second expansion device is controlled based on the degree of superheat measured until the measured degree of superheat reaches a preset degree of superheat.

In the present invention, if the degree of superheat of refrigerant is within a preset range of a target degree of superheat, the control unit fuzzy-controls the opening amount of the first expansion device.

In the present invention, if at least one of values of the operating parameters is out of a preset normal operating range, the control unit closes the injection valve.

In the present invention, when the compressor is stopped, the control unit closes the injection valve and fully opens the first and second expansion devices.

In the present invention, when the compressor is stopped, the control unit closes the injection valve, maintains the opening degrees of the first and second expansion devices for a set period of time, and then gradually increases the opening degrees of the first and second expansion devices.

In the present invention, the compressor comprises a first compressing part for introducing and compressing the refrigerant passed through the evaporator and a second compressing part for introducing and compressing the refrigerant passed through the first compressing part and the refrigerant branched and injected between the first expansion device and the second expansion device.

Furthermore, the present invention provides an air conditioning system, comprising: a condenser for condensing a refrigerant; a first expansion device for throttling the refrigerant passed through the condenser; a second expansion device for throttling the refrigerant passed through the first expansion device; an evaporator for evaporating the refrigerant passed through the second expansion device; a compressor for introducing and compressing the refrigerant passed through the evaporator and the refrigerant branched and injected between the first expansion device and the second expansion device; an injection valve for adjusting the amount of refrigerant branched between the first expansion device and the second expansion device and injected into the compressor; and a control unit for controlling the first and second expansion valves and the injection valve, wherein the control unit decreases the opening degree of the first expansion device for a set period of time before and after the opening of the injection valve, maintains the opening degree of the second expansion device, and controls the opening amount of the first expansion device in an intermediate pressure control method for adjusting the intermediate pressure of refrigerant when the opening degree of the injection valve reaches a target opening degree, and controls the opening amount of the second expansion device in a superheat degree control method for adjusting the degree of superheat of refrigerant.

Furthermore, the present invention provides an air conditioning system, comprising: a condenser for condensing a refrigerant; a first expansion device for throttling the refrigerant passed through the condenser; a second expansion device for throttling the refrigerant passed through the first expansion device; an evaporator for evaporating the refrigerant passed through the second expansion device; a compressor for introducing and compressing the refrigerant passed through the evaporator and the refrigerant branched and injected between the first expansion device and the second expansion device; an injection valve for adjusting the amount of refrigerant branched between the first expansion device and the second expansion device and injected into the compressor; and a control unit for controlling the first and second expansion valves and the injection valve, wherein, upon starting up the compressor, the control unit decreases the opening degree of at least one of the first and second expansion devices, and then increases the same based on the start-up of the compressor, and upon completion of the start-up of the compressor, the control unit controls the opening amount of the first expansion device in an intermediate pressure control method for adjusting the intermediate pressure of refrigerant and controls the opening amount of the second expansion device in a superheat degree control method for adjusting the degree of superheat of refrigerant.

The air conditioning system according to the present invention is able to decrease the amount of refrigerant between the first expansion device and the injection valve and thus adjust the pressure of an injected refrigerant by decreasing the opening degree of the first expansion device and maintaining the opening degree of the second expansion device upon opening of the injection valve, thereby making the system stable upon opening of the injection valve.

Furthermore, in the present invention, upon starting up the compressor, the opening degrees of the first and second expansion devices are partly decreased based on the start-up of the compressor and then gradually opened again, and upon completion of the start-up of the compressor, the opening amounts of the first and second expansion devices and the injection valve are controlled, thereby making the cycle more stable.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

An air conditioning system includes general residential cooling air conditioner for performing a cooling operation only, a heating air conditioner for performing a heating operation only, a heat pump type air conditioner for performing both cooling and heating operations, and a multi-type air conditioner for cooling and heating a plurality of indoor spaces. Hereinafter, as one example of the air conditioning system, a heat pump type air conditioner (hereinafter, referred to as "air conditioner") will be described in details.

Hereinafter, an embodiment of the present invention will be described below with reference to the accompanying drawings.

Figure 1:
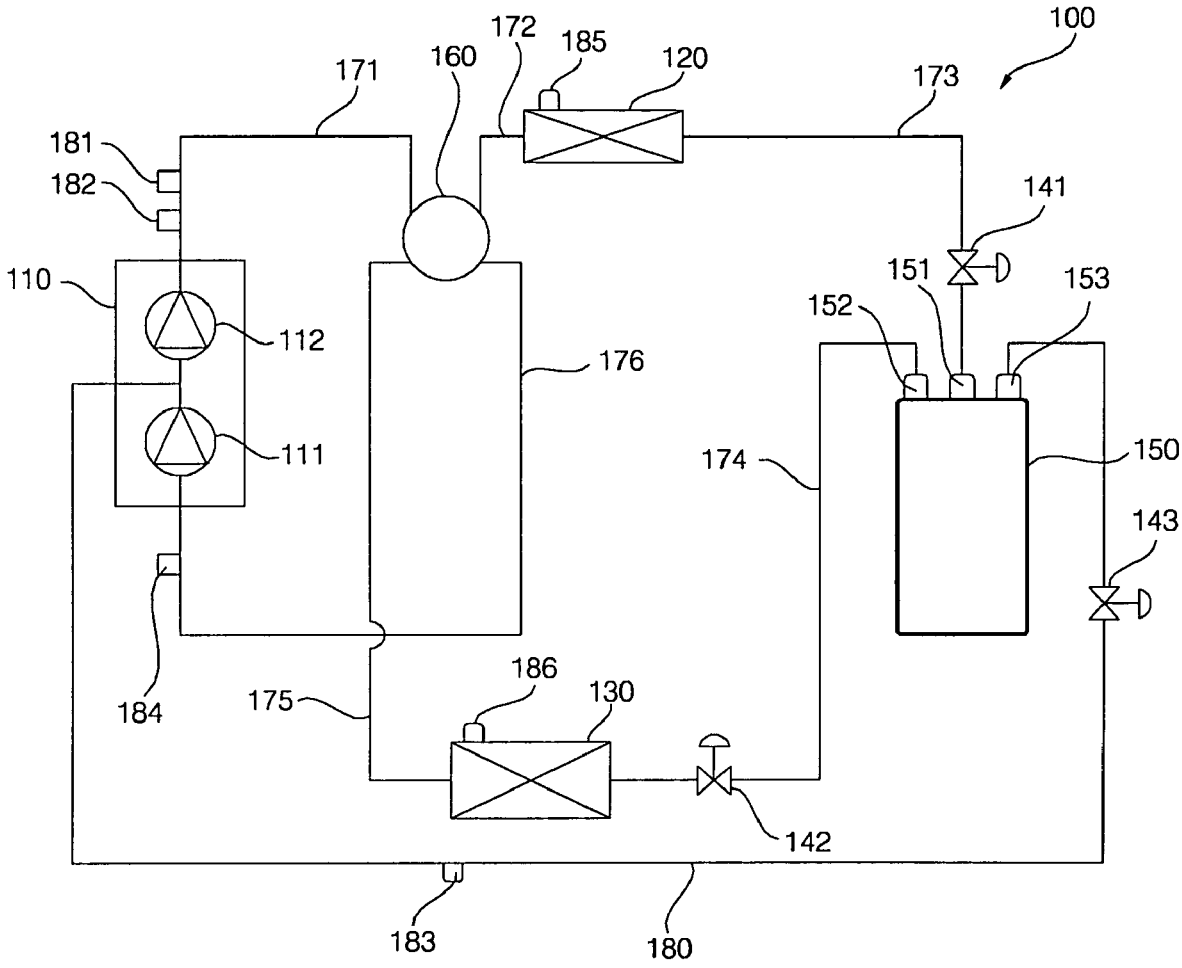
FIG. 1 is a view showing the construction of an air conditioner in accordance with an embodiment of the present invention.
Figure 2:
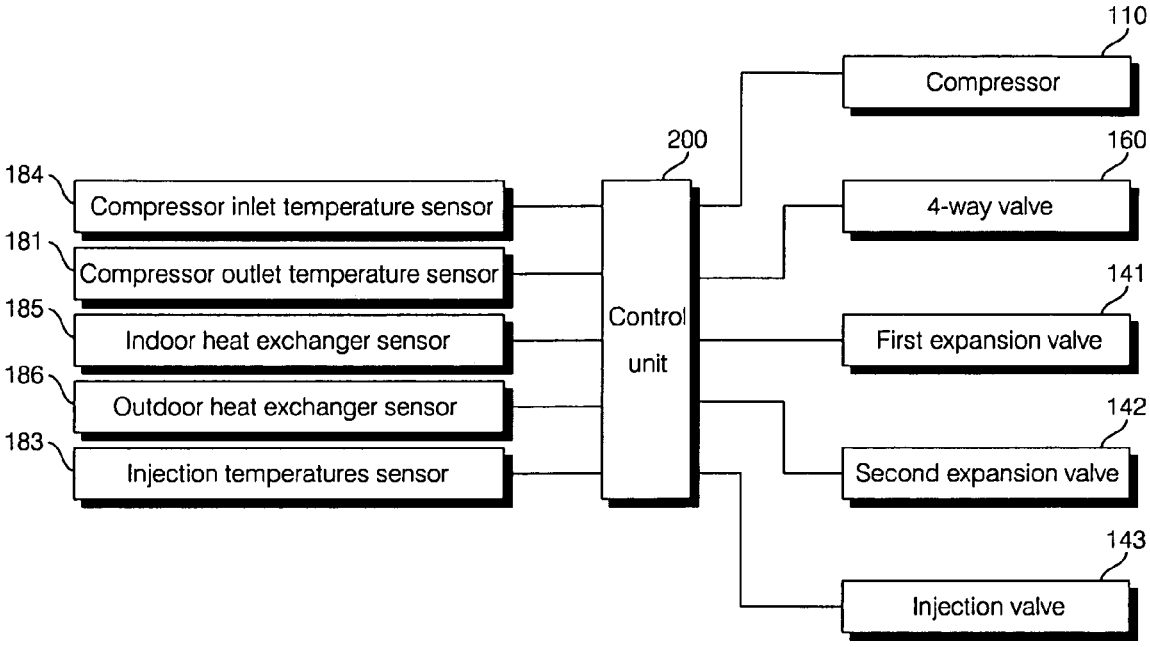
FIG. 2 is a block diagram showing a control flow of the air conditioner.

FIG. 1 is a view showing the construction of an air conditioner 100 in accordance with an embodiment of the present invention. FIG. 2 is a block diagram showing a control flow of the air conditioner 100.

Referring to FIGS. 1 and 2, the air conditioner 100 includes a compressor 110, an indoor heat exchanger 120, an outdoor heat exchanger 130, a first expansion valve 141, a second expansion valve 142, a phase separator 150, and a 4-way valve 160. The indoor heat exchanger 120 functions as an evaporator in a cooling operation and functions as a condenser in a heating operation. The compressor 110 compresses an introduced refrigerant of low temperature and low pressure into a refrigerant of high temperature and high pressure. The compressor 110 includes a first compressing part 111 and a second compressing part 112. The first compressing part 111 compresses the refrigerant introduced from the evaporator, and the second compressing part 112 mixes and compresses the refrigerant coming from the first compressing part 111 and the refrigerant injected by being branched between the evaporator and the condenser. However, the present invention is not limited thereto, and the compressor 110 can have a multi-layered structure more than three layers.

The 4-way valve 160 is a flow path switching valve for switching the flow of refrigerant upon cooling and heating, and guides the refrigerant compressed in the compressor 110 to the outdoor heat exchanger 130 upon cooling and guides the same to the indoor heat exchanger 120 upon heating. The 4-way valve 160 and the compressor 110 are connected via a first connecting pipe 171. A compressor outlet temperature sensor 181 and a discharge pressure sensor 182 are disposed on the first connecting pipe 171 in order to measure the discharge temperature and pressure of the refrigerant discharged from the compressor 110. The indoor heat exchanger 120 is disposed in a room, and is connected to the 4-way vale 160 via a second connecting pipe 172. An indoor heat exchanger sensor 185 is installed at the indoor heat exchanger 120.

The phase separator 150 separates an introduced refrigerant into a gaseous refrigerant and a liquid refrigerant, sends the liquid refrigerant to the evaporator, and sends the gaseous refrigerant to the second compressing part 112. A first connecting part 151 of the phase separator 150 and the indoor heat exchanger 120 are connected via a third connecting pipe 173. The first connecting part 151 serves as a liquid refrigerant discharge pipe in a cooling operation and serves as a refrigerant inlet pipe in a heating operation.

The first expansion valve 141 is disposed on the third connecting pipe 173, and serves as a second expansion device for throttling the liquid refrigerant introduced from the phase separator 150 in a cooling operation and serves as a first expansion device for throttling the liquid refrigerant introduced from the indoor heat exchanger 120 in a heating operation.

The outdoor heat exchanger 130 is disposed outdoors, and is connected to a second connecting part 152 of the phase separator 150 via a fourth connecting pipe 174. An outdoor heat exchanger sensor 186 is installed at the outdoor heat exchanger 130. The second connecting pipe 152 serves as a refrigerant inlet pipe in a cooling operation and serves as a liquid refrigerant discharge pipe in a heating operation.

The second expansion valve 142 is disposed on the fourth connecting pipe 174, and serves as a first expansion device for throttling the liquid refrigerant introduced from the heat exchanger 130 in a cooling operation and serves as a second expansion device for throttling the liquid refrigerant introduced from the phase separator 150 in a heating operation.

The outdoor heat exchanger 130 is connected to the four-way valve 160 via a fifth connecting pipe 175. Also, the 4-way valve 160 and an inlet pipe of the compressor 110 are connected via a sixth connecting pipe 176. A compressor inlet temperature sensor 184 for measuring the temperature of the inlet side of the compressor 110 is disposed on the sixth connecting pipe 176.

The second compressing part 112 is connected to a third connecting part 153 of the phase separator 150 via an injection pipe 180. The third connecting pipe 153 is used as a gaseous refrigerant discharge pipe in cooling and heating operations.

An injection valve 143 is disposed on the injection pipe 180. The injection valve 143 controls the amount and pressure of the refrigerant injected into the second compressing part 112 from the phase separator 150. When the injection pipe 180 is opened, the gaseous refrigerant in the phase separator 150 is introduced into the second compressing part 112 through the injection pipe 180. An injection temperature sensor 183 for measuring the temperature of the refrigerant being injected is disposed on the injection pipe 180.

The opening degree of the first and second expansion valves 141 and 142 and the injection valve 143 is controlled by a control unit 200 for controlling the operation of the air conditioner.

Figure 3:
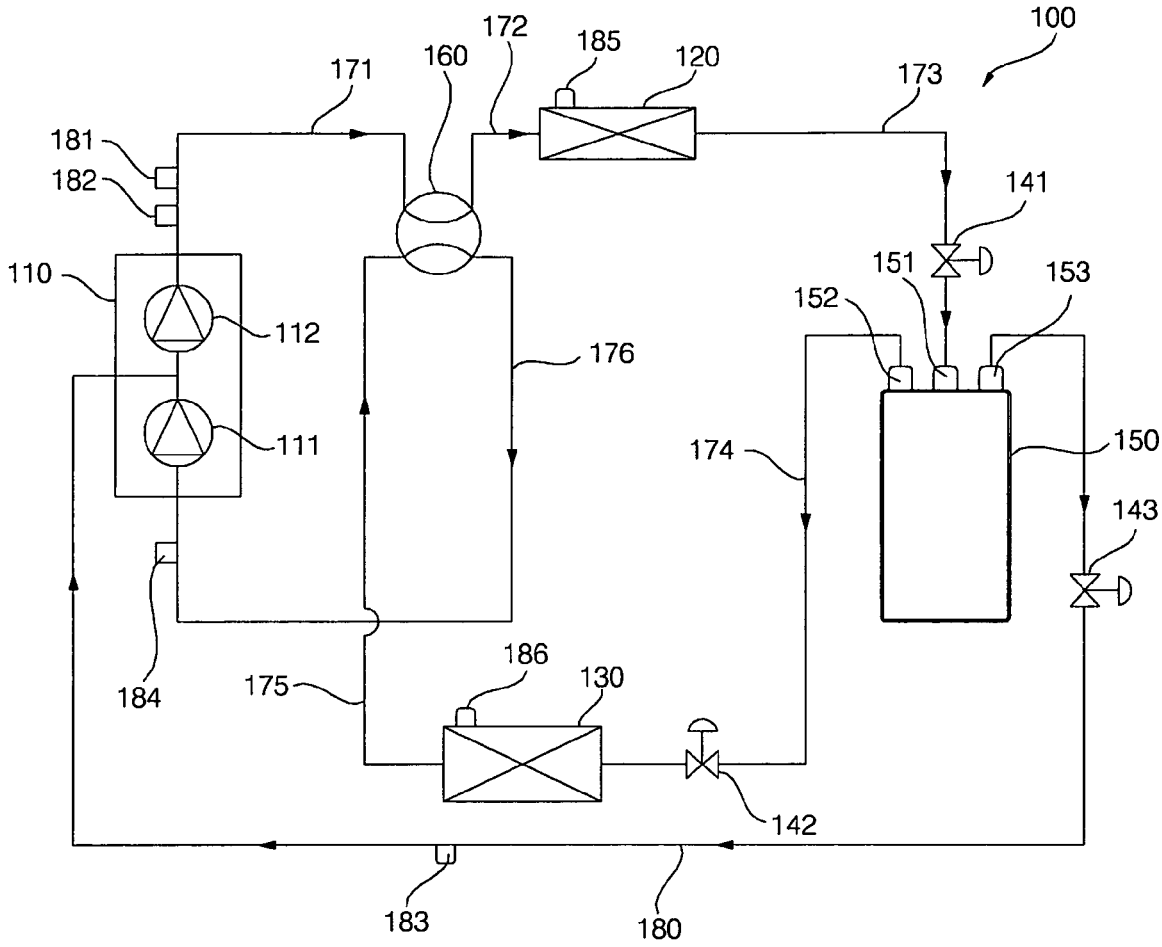
FIG. 3 illustrates the flow of refrigerant in the heating operation of the air conditioner.

FIG. 3 illustrates the flow of refrigerant in the heating operation of the air conditioner.

Referring to FIG. 3, a gaseous refrigerant of high temperature and high pressure discharged from the compressor 110 is introduced into the indoor heat exchanger 120 via the 4-way valve 160. In the indoor heat exchanger 120, the gaseous refrigerant is condensed by heat exchange with indoor air. The condensed refrigerant is throttled in the first expansion valve 141, and then introduced into the phase separator 150. At this time, the opening amount of the first expansion valve 141 can be adjusted so as to make a pressure in the phase separator 150 reach a preset intermediate pressure. Therefore, the first expansion valve 141 serves as a first expansion device for adjusting the intermediate pressure of refrigerant.

The liquid refrigerant separated by the phase separator 150 is throttled again in the second expansion valve 142. At this time, the opening amount of the second expansion valve 142 can be adjusted so as to adjust the degree of superheat of the refrigerant. Therefore, the second expansion valve 142 serves as a second expansion device for adjusting the degree of superheat of refrigerant.

The refrigerant throttled in the second expansion valve 142 is introduced into the outdoor heat exchanger 130. The refrigerant in the outdoor heat exchanger 130 is evaporated by heat exchange with outside air, and the evaporated refrigerant is introduced into the first compressing part 111.

If there is a request for performing gas injection during the heating operation, the control unit 200 opens the injection valve 143. As the injection valve 143 is opened, the gaseous refrigerant separated in the phase separator 150 is injected into the second compressing part 112 through the injection pipe 180. In the second compressing part 112, the injected refrigerant and the refrigerant coming from the first compressing part 111 are mixed and then compressed. The refrigerant compressed in the second compressing part 112 circulates again to the 4-way valve 160.

Figure 4:
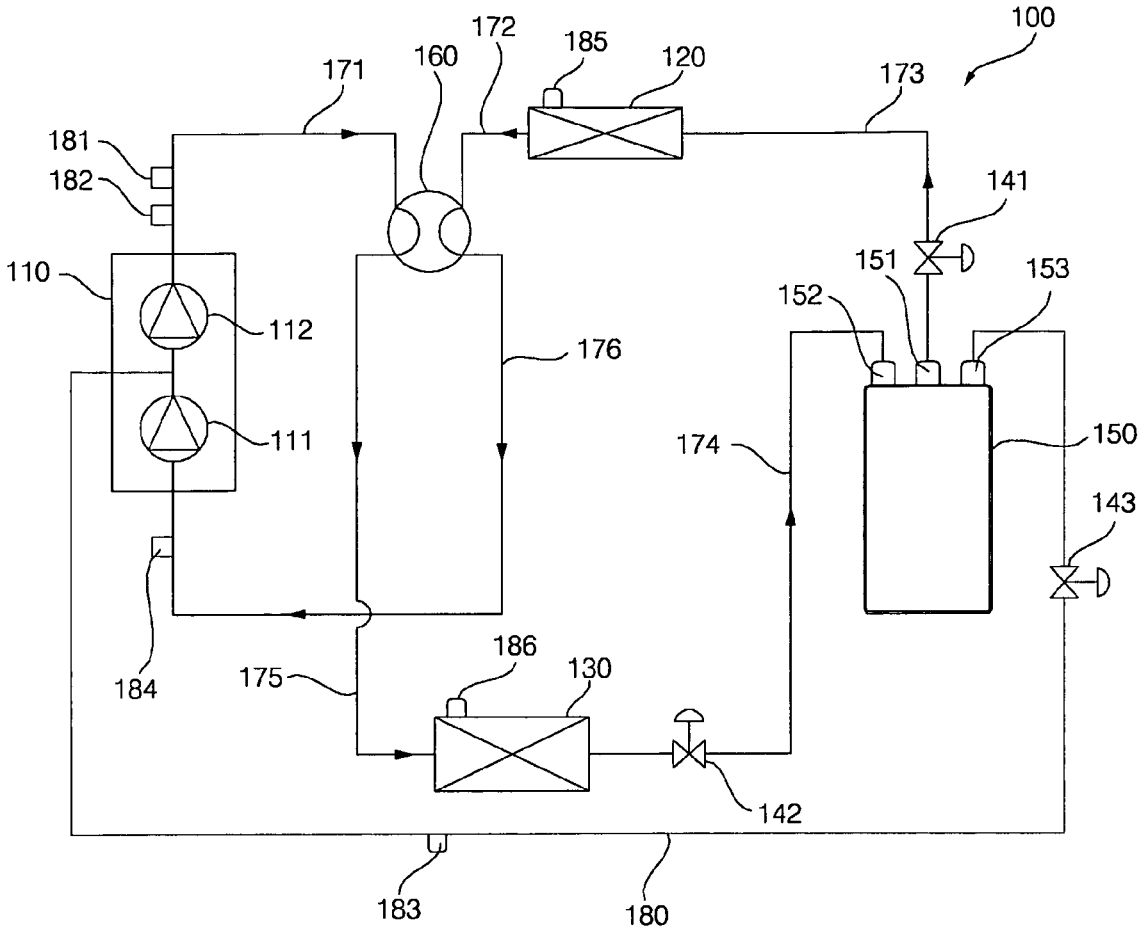
FIG. 4 illustrates the flow of refrigerant in the cooling operation of the air conditioner.

FIG. 4 illustrates the flow of refrigerant in the cooling operation of the air conditioner.

Referring to FIG. 4, a gaseous refrigerant of high temperature and high pressure discharged from the compressor 110 is introduced into the outdoor heat exchanger 130 via the 4-way valve 160. In the outdoor heat exchanger 130, the gaseous refrigerant is condensed by heat exchange with indoor air. The condensed refrigerant is throttled in the second expansion valve 142, and then introduced into the phase separator 150.

The liquid refrigerant separated by the phase separator 150 is throttled again in the first expansion valve 141, and then introduced into the indoor heat exchanger 120. The refrigerant in the indoor heat exchanger 120 is evaporated by heat exchange with ambient air, and the evaporated refrigerant is introduced into the first compressing part 111. If there is no request for performing gas injection during the cooling operation, the control unit 200 closes the injection valve 143, thus keeping the gaseous refrigerant coming from the phase separator 150 from being injected into the second compressing part 112. However, the present invention is not limited thereto, and in the cooling operation, too, the gaseous refrigerant coming from the phase separator 150 may be injected into the second compressing part 112.

A method of controlling an air conditioner in accordance with the embodiment of the present invention will be described below.

Figure 5A:
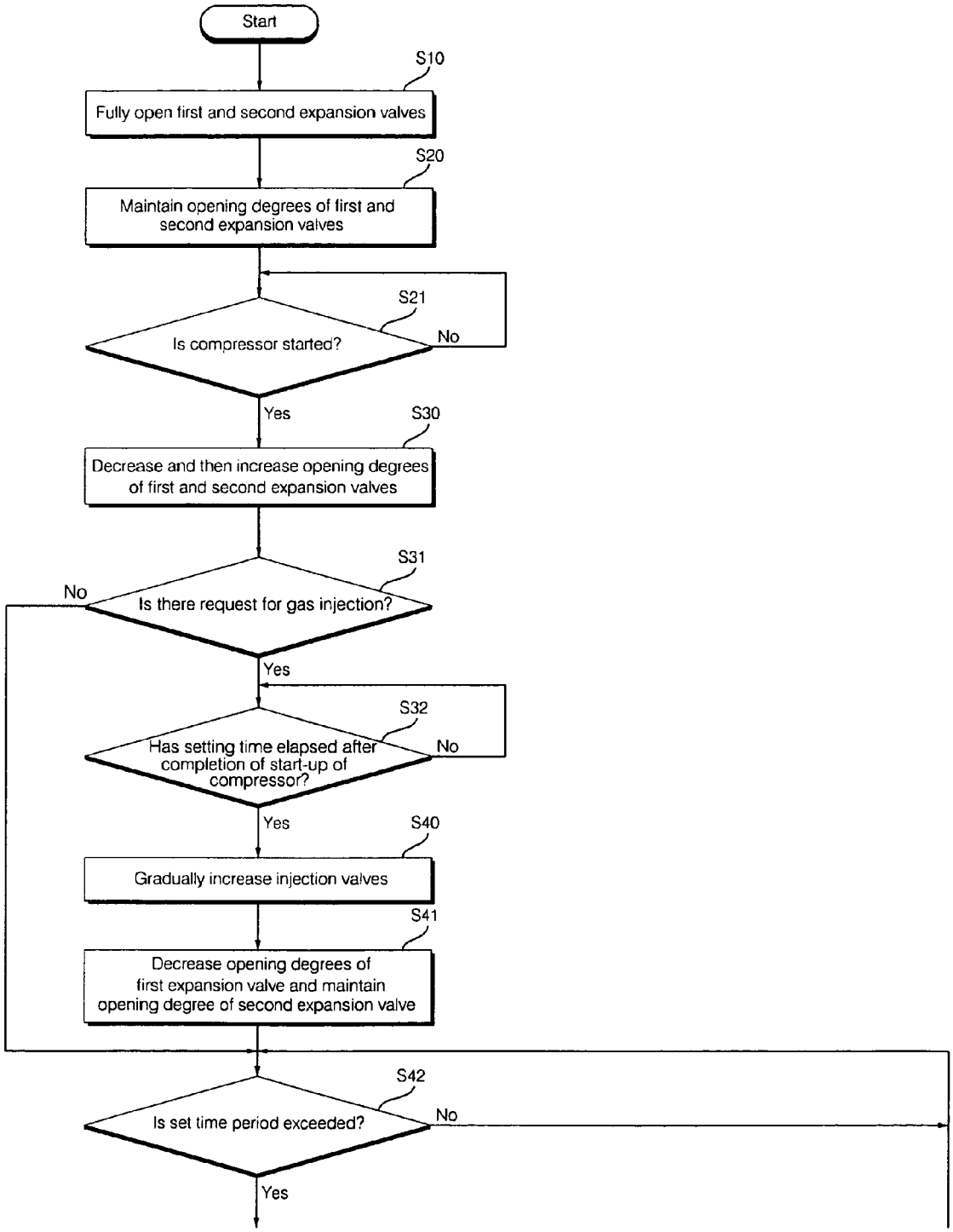
FIG. 5 is a sequential view illustrating a control method when the air conditioner as shown in FIG. 1 is in a heating operation mode.
Figure 5B:
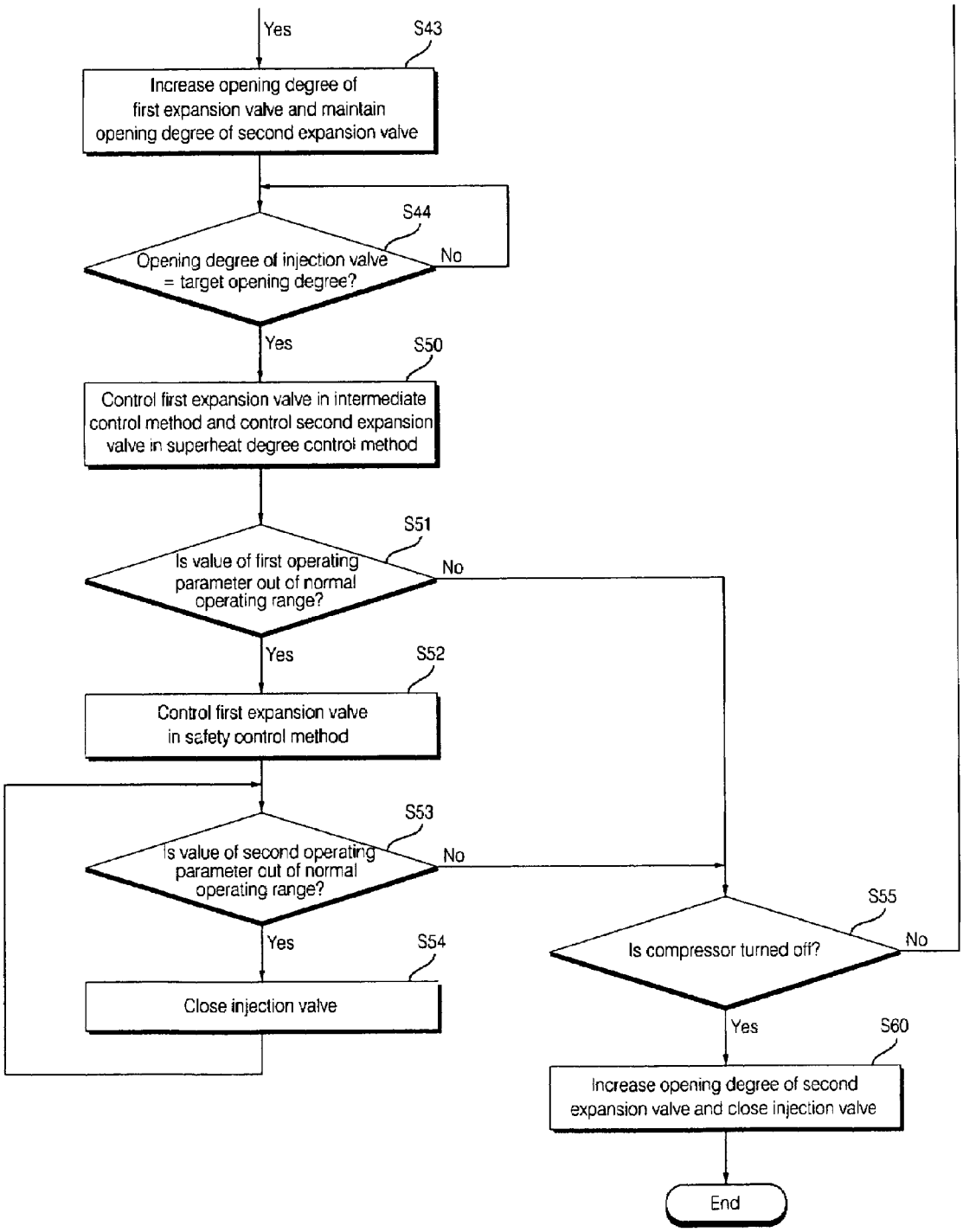
Figure 6:
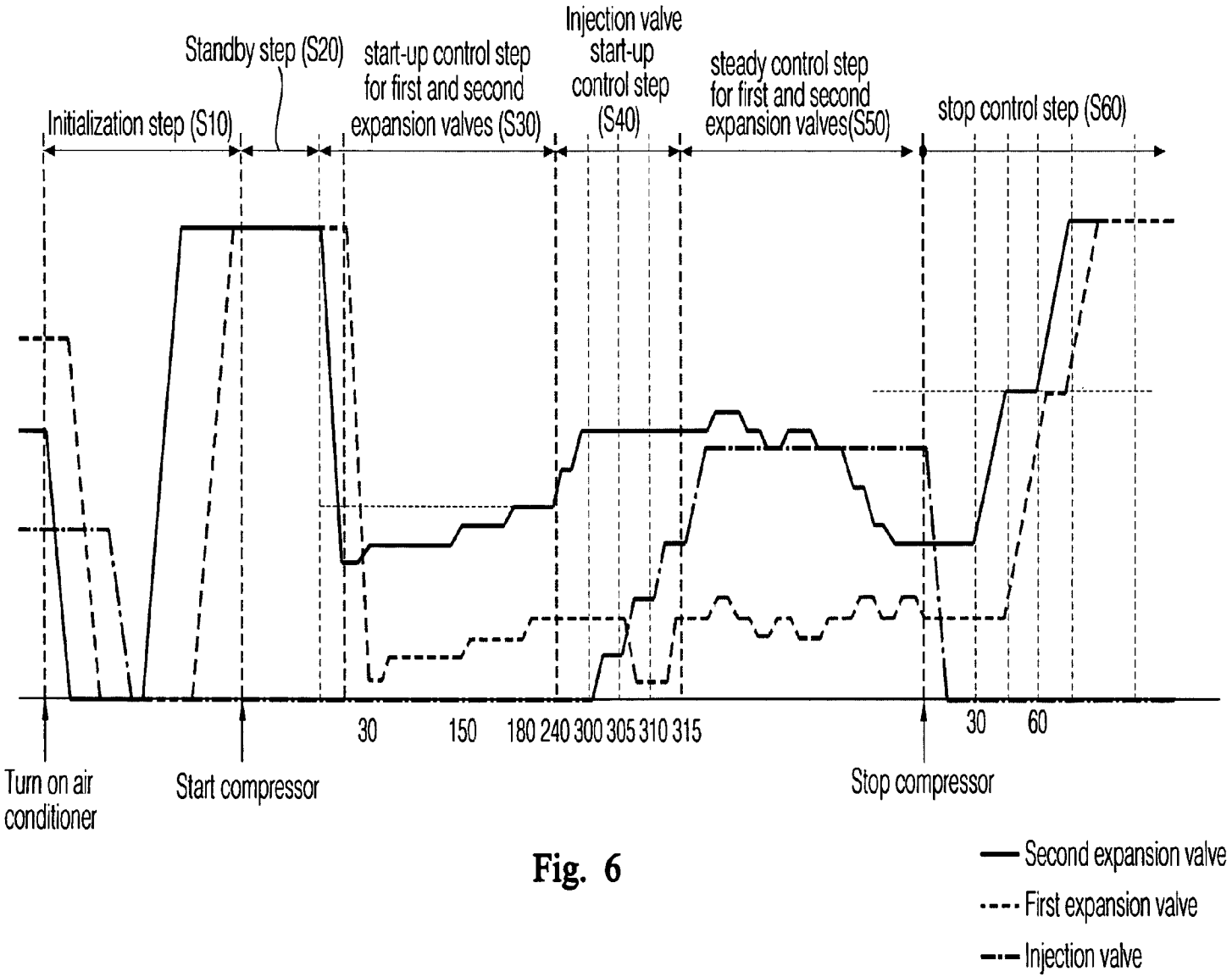
FIG. 6 is a graph illustrating changes in opening degrees of first and second expansion valves and an injection valve according to an operating state of the air conditioner when the air conditioner as shown in FIG. 1 is the heating operation mode.

FIG. 5 is a sequential view illustrating a control method when the air conditioner as shown in FIG. 1 is in a heating operation mode. FIG. 6 is a graph illustrating changes in opening degrees of first and second expansion valves and an injection valve according to an operating state of the air conditioner when the air conditioner as shown in FIG. 1 is the heating operation mode Referring to FIGS. 5 and 6, when current is applied to the air conditioner 100 and the air conditioner 100 is turned on, the control unit 200 performs an initialization step S10 of initializing the first and second expansion valves 141 and 142 and the injection valve 143.

In the initialization step S10, the first and second expansion valves 141 and 142 are fully opened, and the injection valve 143 is closed. By closing the injection valve 143 in the initialization step S10, a liquid refrigerant can be prevented from being introduced into the compressor 110 at an initial stage of driving. Opening speeds of the first and second expansion valves 141 and 142 may be different from each other.

Once the first and second expansion valves 141 and 142 are fully opened in the initialization step S10, the control unit 200 performs a standby step S20 of maintaining an opened state of the first and second expansion valves 141 and 142 until the start-up of the compressor 110.

Once the compressor 110 is started up in S21, the control unit 200 performs a start-up control step S30 for the first expansion valves 141 and 142 in which opening amounts of the first and second expansion vales 141 and 142 are controlled based on the start-up of the compressor 110.

Figure 7:
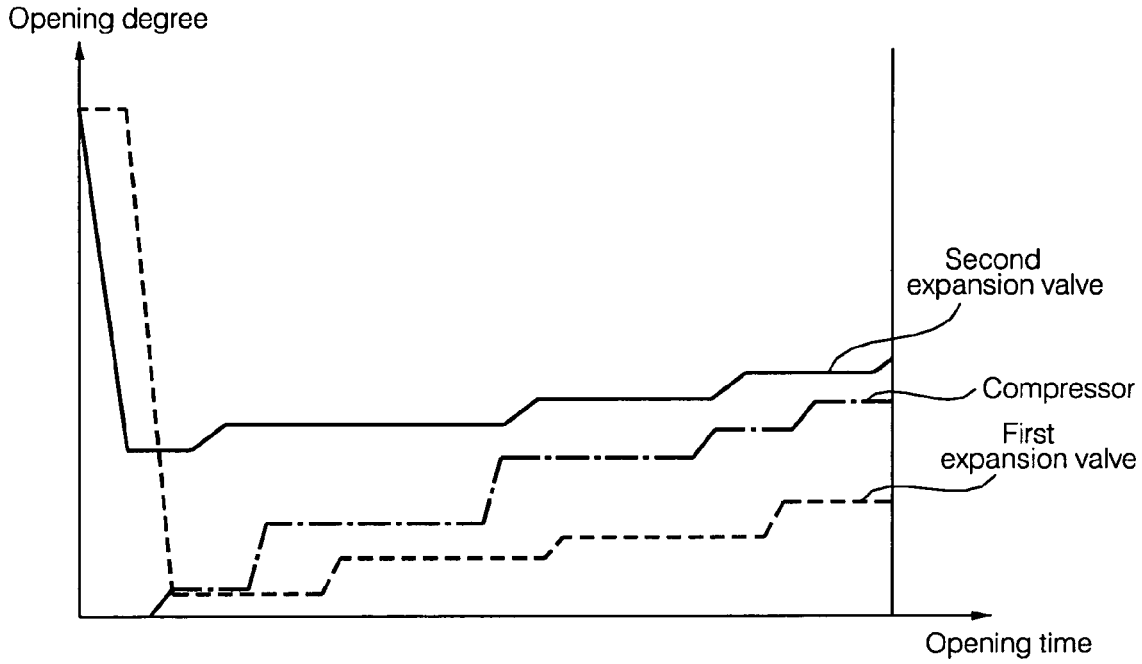
FIG. 7 is a graph showing changes in opening degrees of the first and second expansion valves when the air conditioner as shown in FIG. 1 is in a heating operation and a compressor is started.

FIG. 7 is a graph showing changes in opening degrees of the first and second expansion valves when the air conditioner as shown in FIG. 1 is in a heating operation and a compressor is started.

Referring to FIG. 7, in the start-up control step S30 for the first and second expansion valves 141 and 142, opening degrees of the first and second expansion valves 141 and 142 are decreased, and then increased so that the opening degrees of the first and second expansion valves 141 and 142 may reach respective preset basic opening degrees.

In the start-up control step S30 for the first and second expansion valves 141 and 142, a method of decreasing opening degrees of the first and second expansion valves 141 and 142 is as follows. The control unit 200 decreases the opening degrees so that the opening degrees of the first and second expansion valves 141 and 142 may reach within a predetermined range of the basic opening degrees. In one example, the opening degrees of the first and second expansion valves 141 and 142 may be decreased until they reach 70% of the basic opening degrees. The basic opening degree of the first expansion valve 141 and the basic opening degree of the second expansion valve 142 may be set differently from each other.

In the start-up control step S30 for the first and second expansion valves 141 and 142, a method of increasing opening degrees of the first and second expansion valves 141 and 142 is as follows. Referring to FIG. 7, the control unit 200 repeats a change process of changing the opening amounts of the first and second expansion valves 141 and 142 until the opening degrees of the first and second expansion valves 141 and 142 reach the basic opening degrees and a maintenance process of maintaining the opening degrees. That is to say, the opening amounts of the first and second expansion valves 141 and 142 are increased by a predetermined amount, and then the opening degrees thereof are maintained for a predetermined period of time. Afterwards, the opening amounts of the first and second expansion valves 141 and 142 are increased by a predetermined amount, and then the opening degrees thereof are maintained for a predetermined period of time. The change process and the maintenance process are repeated until the opening degrees of the first and second expansion valves 141 and 142 reach the respective basic opening degrees. A change in the opening degrees of the first and second expansion valves 141 and 142 for each time period may be set the same, or may be set different according to an opening time period.

When the opening degrees of the first and second expansion valves 141 and 142 reach the respective basic opening degrees, the start-up control step S30 for the first and second expansion valves 141 and 142 is finished.

Once the start-up control step S30 for the first and second expansion valves 141 and 142 is finished, it is judged whether or not there is a request for gas injection for injecting a gaseous refrigerant coming from the phase separator 150 into the second compressing part 112 in S31. If there is a request for gas injection, the control unit 200 judges whether a set time period has elapsed or not after the completion of the start-up of the compressor 110 in S32. Because the opening of the injection valve 143 is started after judging that the compressor 110 is normally operated with the completion of the start-up of the compressor 110, the cycle can be performed more stably. If it is judged that a set time period has elapsed after the completion of the start-up of the compressor 110, the start-up control step S40 of the injection valve 143 is performed.

Figure 8:
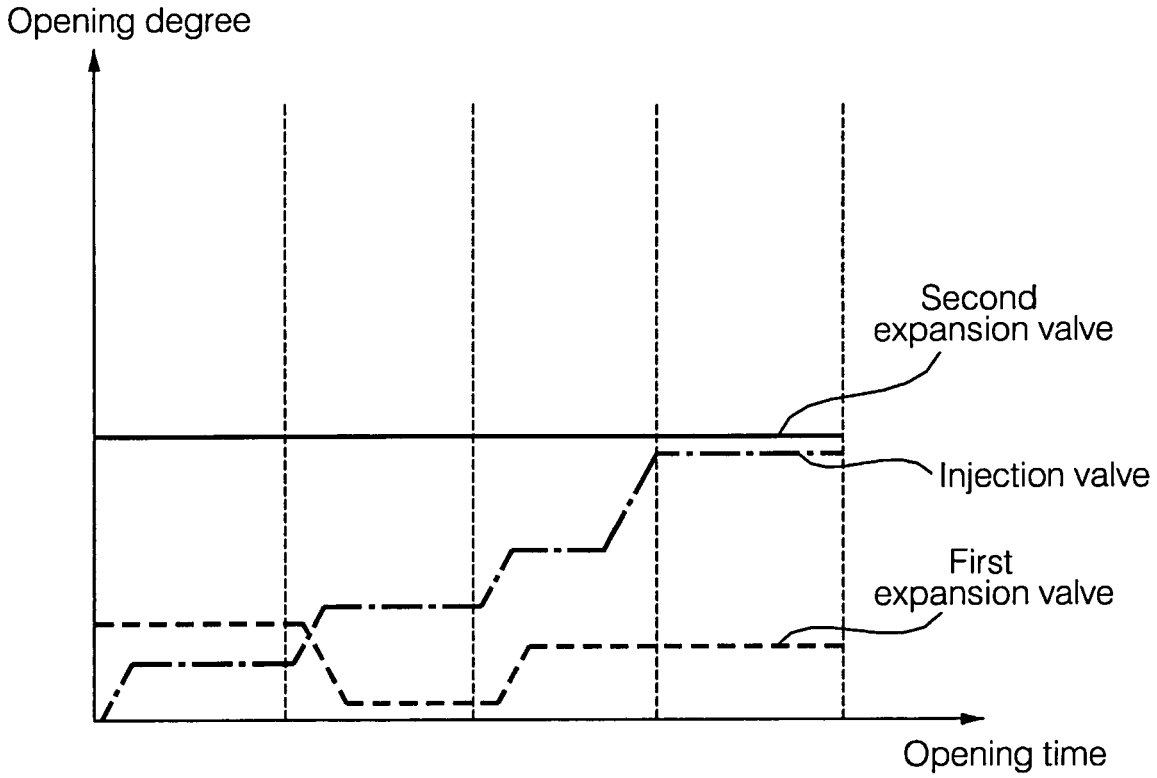
FIG. 8 is a graph showing changes in opening degrees of the first and second expansion valves when the air conditioner as shown in FIG. 1 is in a heating operation and the injection valve is started.

FIG. 8 is a graph showing changes in opening degrees of the first and second expansion valves when the air conditioner as shown in FIG. 1 is in a heating operation and an injection valve is started.

Referring to FIG. 8, in the start-up control step S40 for the injection valve 143, a change process of changing an opening degree of the injection valve 143 until the injection valve 143 is fully opened and a maintenance process of maintaining the changed opening degree are repeated. A change in the opening degree of the injection valve 143 for each time period is controlled so as to change according to an opening time. As the opening time of the injection valve 143 increases, a change in the opening degree of the injection valve 143 increases.

Therefore, the injection valve 143 is opened little by little in the initial stage of opening of the injection valve 143 to prevent the phenomenon of an increase in the discharge pressure of the compressor 110, and then a change in the opening degree of the injection valve 143 is gradually increased, thus making the opening degree of the injection valve rapidly reach a target opening degree. Further, upon control of the injection valve 143, a time period for maintaining a changed opening degree is provided after the change of the opening degree, thereby preventing an abrupt change in flow rate from occurring in the initial stage of opening of the injection valve 143. Subsequently, the discharge pressure of the compressor 110 can be prevented, and the cycle can be further stabilized.

Additionally, referring to FIG. 8, upon opening of the injection valve 143, the control valve 200 decreases the opening degree of the first expansion valve 141 for a set period of time and then increases it, and maintains the opening degree of the second expansion valve 142 in S41. In other words, the opening degree of the first expansion valve 141 is decreased immediately after opening the injection valve 141. When decreasing the opening degree of the first expansion valve 141, the opening degree of the first expansion valve 141 is controlled so as to be within a predetermined range of a stored opening degree. In one example, the opening degree of the first expansion valve 141 can be decreased so that the opening degree of the first expansion valve 141 may reach 50% of the stored opening degree. The control unit 200 maintains the decreased opening degree after decreasing the opening degree of the first expansion valve 141.

Thereafter, when the set period of time is exceeded in S42, the opening degree of the first expansion valve 141 is increased in S43. Upon increasing the opening degree of the first expansion valve 141, the opening degree is increased so as to reach a stored opening degree. After the increase of the opening degree of the first expansion valve 141, the opening degree of the first expansion valve 141 is maintained until the injection valve 143 is fully opened.

The control unit 200 stops the control of the second expansion valve 142 to allow the second expansion valve 142 to continuously maintain its opening degree.

Accordingly, upon opening the injection valve 143, the first expansion valve 141 is partly closed, and the opening degree of the second expansion valve 142 is maintained, and this may cause a decrease in the amount of refrigerant in the phase separator 150, thereby preventing an increase in the discharge pressure in the phase separator 150.

Afterwards, when the opening degree of the injection valve 143 reaches a target opening degree in S44, the control unit 200 performs a scheduled control step S50 for controlling the opening amount of the first and second expansion valves 141.

Referring to FIGS. 5 and 6, in the scheduled control step S50, the control unit 200 controls the opening amount of the first expansion valve 141 in an intermediate control method for adjusting the intermediate pressure of refrigerant, and controls the opening amount of the second expansion valve 142 in a superheat degree control method for adjusting the degree of superheat of refrigerant:

First, the superheat degree control method is a method of controlling the opening amount of the second expansion valve 142 based on the degree of superheat of refrigerant. In other words, the control unit 200 measures the degree of superheat of refrigerant in real time, and controls the opening amount of the second expansion valve 142 based on the measured degree of superheat of refrigerant and a gradient of difference in the degree of superheat. The control unit 200 stores a fuzzy table therein based on a difference between the degree of superheat measured in the outdoor heat exchanger sensor 186 and the compressor inlet temperature sensor 184 and a preset target degree of superheat and a change in difference, and the opening amount of the second expansion valve 142 is determined from the fuzzy table. The control unit 200 measures the degree of superheat of refrigerant in real time until the degree of superheat of refrigerant reaches the target degree of superheat, and continuously changes the opening amount of the second expansion valve 142 based on the measured degree of superheat. Hence, the degree of superheat of refrigerant can be adjusted more accurately.

In the intermediate pressure control method, a value of at least one of operating parameters is detected, and a target opening degree of the first expansion valve 141 is determined based on a stored set value corresponding to the detected value of the operating parameter. The operating parameters may include the operability of gas injection in which refrigerant is injected into the second compressing part 112, the frequency of the compressor 110, the indoor temperature of the air conditioner 100, an outdoor temperature, the difference between the indoor and outdoor temperatures, the discharge pressure of the compressor 110, the discharge temperature of the compressor 110, etc. The set values for the operating parameters are preset and stored in a table format in the control unit 200. The set value for the frequency of the compressor 110 may be set differently according to the operability of gas injection.

The set values for the operating parameters change the target opening degree independently.

Once the opening degree is determined, the control unit 200 may increase or decrease the opening amount of the first expansion valve 141 until the opening degree of the first expansion valve 141 reaches the target opening degree.

Alternatively, the control unit 200 may detect and store the current opening degree of the first expansion valve 141 in real time, and determine a change in opening amount according to a difference between the current opening degree of the first expansion valve 141 and a target opening degree. Once a change in opening degree is determined, the opening degree of the first expansion valve 141 may be changed by the change in opening degree.

While the first expansion valve 141 is being controlled in the intermediate pressure control method, it is judged whether a value of any one of the operating parameters of the air conditioner is out of a preset normal operating range or not in S51.

If the value of the operating parameter is out of the preset normal operating range, the control unit 200 switches from the intermediate pressure control method to a safety control method to control the opening amount of the first expansion valve 141 in S52.

The control unit 200 detects first operating parameters, such as a discharge temperature of refrigerant discharged from the compressor 110, a temperature of refrigerant passed through the indoor heat exchanger 120 serving as a condenser in a heating operation, and so forth, and if at least one of detected values of the first operating parameters is out of the normal operating range, it is judged that there may occur problems such as damaged to the compressor 110 or liquid compression.

The control unit 200 measures a refrigerant discharge temperature of the compressor 110 in order to get the discharge temperature of the refrigerant discharged from the compressor 110 and prevent liquid compression. If the measured refrigerant discharge temperature is out of a preset normal operating range and lower than a preset temperature, the control unit 200 switches from the first control method to the safety control method. The normal operating range is preset and stored in the control unit 200 according to the operating condition or the like of the air conditioner.

In the safety control method, the current opening degree of the first expansion valve 141 stored during the execution of the intermediate pressure control method is combined with a correction opening degree. The correction opening degree may be determined based on the refrigerant discharge temperature. The opening amount of the first expansion valve 141 is controlled according to a combined value of the current opening degree and the correction opening degree. That is to say, the opening amount of the first expansion valve 141 can be increased by adding the correction opening degree to the current opening degree, or the opening amount of the first expansion valve 141 can be decreased by subtracting the correction opening degree from the current opening degree.

During the execution of the safety control method, the current opening degree of the first expansion valve 141 is stored in real time. Therefore, during the execution of the safety control method, the current opening degree stored during the execution of the safety control method is combined with the correction opening degree.

The safety control method is a method of opening or closing as much as the correction opening degree from the current opening degree stored. That is, the opening degree of the first expansion valve 141 is gradually reduced by the correction opening degree until the refrigerant discharge temperature of the compressor 110 is higher than a preset temperature. As the opening degree of the first expansion valve 141 is reduced, the amount of the refrigerant is reduced, thus making it possible to ensure the refrigerant discharge temperature of the compressor 110. Accordingly, liquid compression in the compressor 110 can be prevented.

If the temperature of the refrigerant passed through the indoor heat exchanger 120 is out of the preset normal operating range and lower than a preset temperature, the control unit 200 switches from the intermediate pressure control method to the safety control method.

Further, if the temperature of the refrigerant passed through the indoor heat exchanger 120 is within a preset normal operating range, the discharge temperature of the compressor 110 is measured in order to prevent the discharge temperature of the compressor 110 from being excessively increased. If the discharge temperature of the compressor 110 is out of the normal operating range and exceeds a preset temperature, the control unit 200 switches from the intermediate pressure control method to the safety control method.

If the refrigerant discharge temperature of the compressor 110 returns to the normal operating range during the execution of the safety control method, the control unit 200 switches from the safety control method to the intermediate pressure control method to control the opening amount of the first expansion valve 141.

The control unit 200 judges whether a value of a second operating parameter is out of a preset normal operating range or not during the opening of the injection valve 143 in S53.

The second operating parameter may include a change in the discharge temperature of the compressor 110, a change in the inlet side temperature of the evaporator, a load of the air conditioner 100, a change in current applied to the compressor and so forth. If the value of the second operating parameter is out of the normal operating range, the control unit 200 judges that a liquid refrigerant is injected into the compressor 110, and closes the injection valve 143 for a set period of time in S54.

Accordingly, it is possible to prevent a liquid refrigerant from being injected into the second compressing part 112 from the phase separator 150.

Further, referring to FIGS. 5 and 6, the control unit 200 judges whether the compressor 110 is stopped or not in S55. When the compressor 110 is stopped, the control unit 200 performs a stop control step S60.

In the stop control step S60, the injection valve 143 is closed, the opening degrees of the first and second expansion vales 141 and 142 are maintained for a predetermined period of time, and then the first and second expansion valves 141 and 142 are fully opened. When opening the first and second expansion valves 141 and 142, the process of changing the opening amounts of the first and second expansion valves and the process of maintaining the changed opening degrees can be repeated.

Meanwhile, when the air conditioner 100 is in a cooling operation mode, the second expansion valve 142 serves as a first expansion device for adjusting an intermediate pressure and the first expansion valve 142 serves as a second expansion device for adjusting a degree of superheat.

Figure 9:
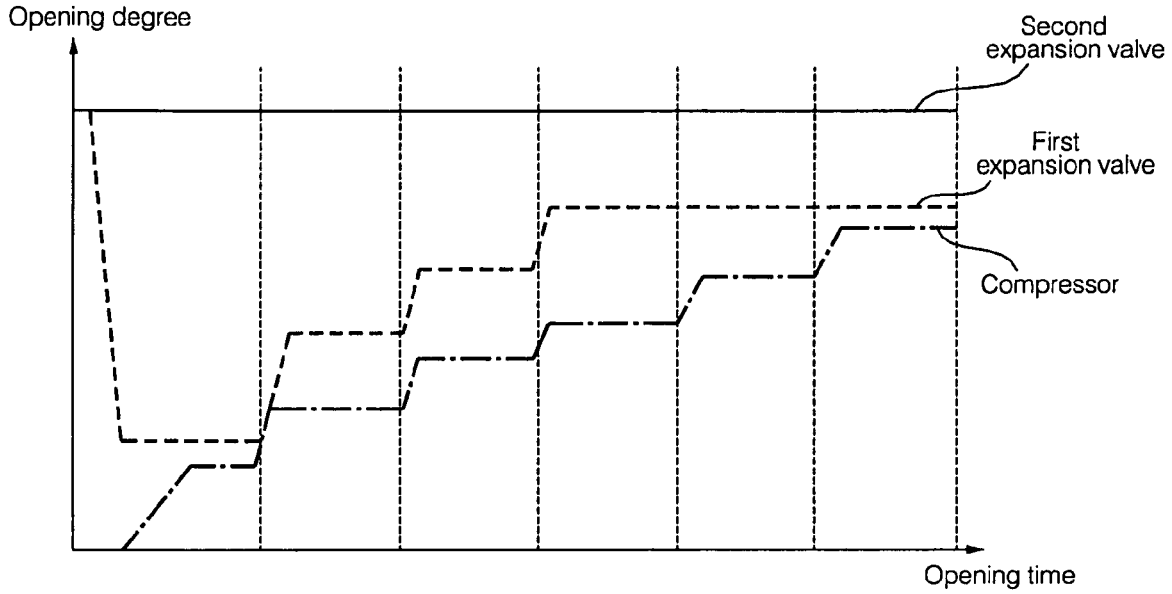
FIG. 9 is a graph showing changes in opening degrees of the first and second expansion valves when the air conditioner as shown in FIG. 1 is in a cooling operation and the compressor is started.

FIG. 9 is a graph showing changes in opening degrees of the first and second expansion valves when the air conditioner as shown in FIG. 1 is in a cooling operation and the compressor is started.

Referring to FIG. 9, when the air conditioner is in a cooling operation, and the compressor 110 is started, the control unit 200 maintains the opening degree of the second expansion valve 142, and decreases the opening degree of the first expansion valve 141 and then increases it. That is to say, the second expansion valve 142 maintains a fully opened state.

Figure 10:
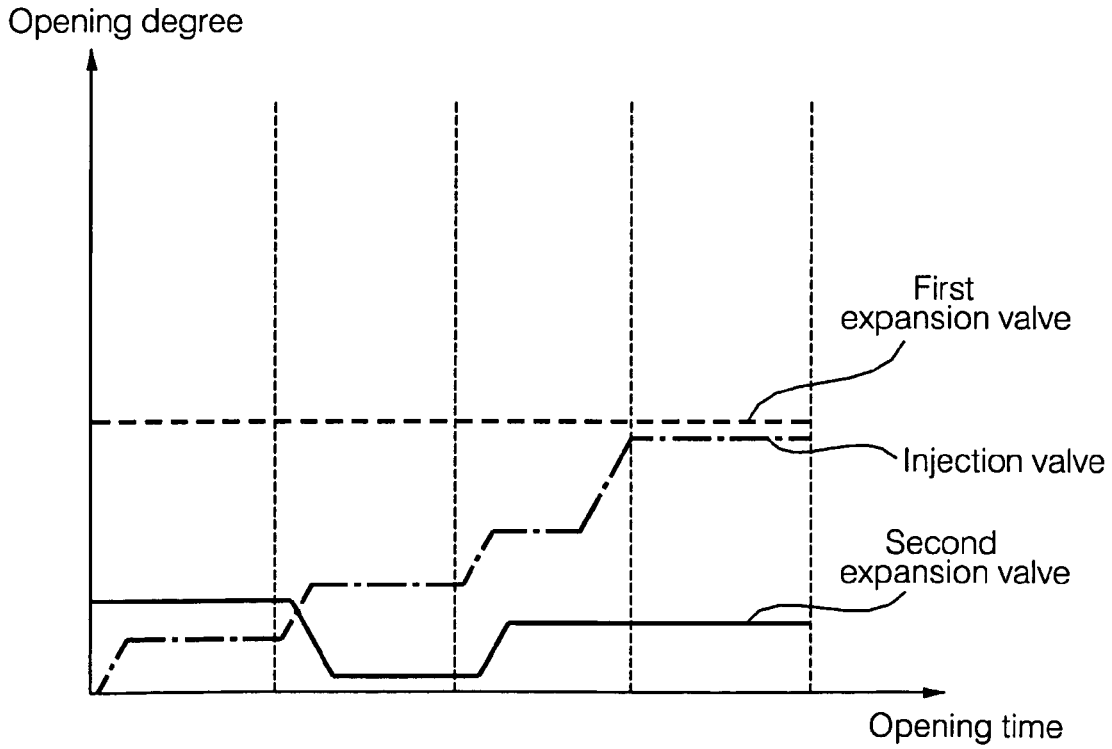
FIG. 10 is a graph showing a change in opening degrees of the first and second expansion valves when the air conditioner as shown in FIG. 1 is in a cooling operation and the injection valve is started.

FIG. 10 is a graph showing changes in opening degrees of the first and second expansion valves when the air conditioner as shown in FIG. 1 is in a cooling operation and the injection valve is started.

Referring to FIG. 10, upon opening the injection valve 143, the control unit 200 decreases the opening degree of the second expansion valve 141 for a set period of time, and the increases it. The opening degree of the first expansion valve 141 is maintained.

Although the present invention has been described with reference to the embodiments shown in the drawings, these are merely illustrative, and those skilled in the art will understand that various modifications and equivalent other embodiments of the present invention are possible. Consequently, the true technical protective scope of the present invention must be determined based on the technical spirit of the appended claims.

The effects of the air conditioner according to the present invention thus constructed will be described below.

The air conditioner according to the present invention is able to decrease the amount of refrigerant between the first expansion device and the injection valve and thus adjust the pressure of an injected refrigerant by decreasing the opening degree of the first expansion device and maintaining the opening degree of the second expansion device upon opening of the injection valve, thereby making the system stable upon opening of the injection valve.

Furthermore, in the present invention, upon starting up the compressor, the opening degrees of the first and second expansion devices are partly decreased based on the start-up of the compressor and then gradually opened again, and upon completion of the start-up of the compressor, the opening amounts of the first and second expansion devices and the injection valve are controlled, thereby making the cycle more stable.

What is claimed is:

1. A method for controlling an air conditioning system that includes a condenser for condensing a refrigerant, a first expansion device for throttling the refrigerant passed through the condenser, a second expansion device for throttling the refrigerant passed through the first expansion device, an evaporator for evaporating the refrigerant passed through the second expansion device, a compressor for compressing the refrigerant passed through the evaporator and the refrigerant branched between the first expansion device and the second expansion device and injected into the compressor, an injection valve for adjusting the amount of refrigerant branched between the first expansion device and the second expansion device and injected into the compressor, and a control unit for controlling opening degrees of the first expansion device, the second expansion device, and the injection valve, the method comprising the steps of:

a) initiating opening the injection valve and then, increasing an opening degree of the injection valve; and b) decreasing an opening degree of the first expansion device for a predetermined period of time and maintaining an opening degree of the second expansion device during performing the step a).

2. The method of 1, wherein, the opening degree of the injection valve increases until the opening degree of the injection valve reaches a target opening degree.

3. The method of claim 1, wherein, a process of increasing and then maintaining the opening degree of the injection valve until the opening degree of the injection valve reaches a target opening degree is repeated.

4. The method of claim 1, wherein the control unit fully opens the first and second expansion devices before current is applied to the air conditioning system and the compressor is started.

5. The method of claim 1, wherein, upon start-up of the compressor, if the air conditioning system is in a heating operation mode, the control unit decreases opening degrees of the first and second expansion devices, and then increases the opening degrees of the first and second expansion devices so as to reach respective preset basic opening degrees.

6. The method of claim 5, wherein the control unit repeats a change process of changing the opening degrees of the first and second expansion devices until the opening degrees of the first and second expansion devices reach respective preset basic opening degrees and a maintenance process of maintaining the opening degrees.

7. The method of claim 1, wherein, upon start-up of the compressor, if the air conditioning system is in a cooling operation mode, the control unit maintains an opening degree of the first expansion device, decreases an opening degree of the second expansion device, and then increases the opening degree of the second expansion device so as to reach a preset basic opening degree.

8. The method of claim 7, wherein the control unit repeats a change process of changing the opening degree of the second expansion device until the opening degree of the second expansion device reach a preset basic opening degree and a maintenance process of maintaining the opening degree.

9. The method of claim 1, wherein, when the opening degree of the injection valve reaches a target opening degree, the control unit controls an opening amount of the first expansion device in an intermediate pressure control method for adjusting an intermediate pressure of refrigerant, and in the intermediate pressure control method, a value of at least one of operating parameters is detected, and the opening amount of the first expansion device is controlled based on a stored set value corresponding to the detected value of the operating parameter.

10. The method of claim 9, wherein, if the value of the operating parameter is out of a preset normal operating range, the control unit controls the first expansion device by switching to a safety control method, which is different from the intermediate pressure control method.

11. The method of claim 9, wherein the operating parameters include a discharge temperature of refrigerant discharged from the compressor and a temperature of refrigerant passed through the condenser, and if a value of at least one of the operating parameters is out of the normal operating range, the first expansion device is controlled by switching to a safety control method, which is different from the intermediate pressure control method.

12. The method of claim 9, wherein, in the safety control method, a preset correction opening degree is combined with the opening degree of the first expansion device stored upon switching from the intermediate pressure control method to thus control the opening amount of the first expansion device.

13. The method of claim 1, wherein, when the opening degree of the injection valve reaches a target opening degree, the control unit controls the second expansion device in a superheat degree control method for adjusting the degree of superheat of refrigerant, and, in the superheat degree control method, the degree of superheat of refrigerant is measured in real time, and the opening amount of the second expansion device is controlled based on the degree of superheat measured until the measured degree of superheat reaches a preset degree of superheat.

14. The method of claim 13, wherein, if the degree of superheat of refrigerant is within a preset range of a target degree of superheat, the control unit fuzzy-controls the opening amount of the first expansion device.

15. The method of claim 1, wherein, if at least one of values of the operating parameters is out of a preset normal operating range, the control unit closes the injection valve.

16. The method of claim 1, wherein, when the compressor is stopped, the control unit closes the injection valve and fully opens the first and second expansion devices.

17. The method of claim 1, wherein, when the compressor is stopped, the control unit closes the injection valve, maintains the opening degrees of the first and second expansion devices for a set period of time, and then gradually increases the opening degrees of the first and second expansion devices.

18. An air conditioning system, comprising:

a condenser for condensing a refrigerant;

a first expansion device for throttling the refrigerant passed through the condenser;

a second expansion device for throttling the refrigerant passed through the first expansion device;

an evaporator for evaporating the refrigerant passed through the second expansion device;

a compressor for compressing the refrigerant passed through the evaporator and the refrigerant branched between the first expansion device and the second expansion device and injected into the compressor;

an injection valve for adjusting the amount of refrigerant branched between the first expansion device and the second expansion device and injected into the compressor; and a control unit for controlling the first and second expansion devices and the injection valve, wherein the control unit decreases the opening degree of the first expansion device for a set period of time before and after the opening of the injection valve, maintains the opening degree of the second expansion device, and controls the opening amount of the first expansion device in an intermediate pressure control method for adjusting the intermediate pressure of refrigerant when the opening degree of the injection valve reaches a target opening degree, and controls the opening amount of the second expansion device in a superheat degree control method for adjusting the degree of superheat of refrigerant.

19. An air conditioning system, comprising:

a condenser for condensing a refrigerant;

a first expansion device for throttling the refrigerant passed through the condenser;

a second expansion device for throttling the refrigerant passed through the first expansion device;

an evaporator for evaporating the refrigerant passed through the second expansion device;

a compressor for compressing the refrigerant passed through the evaporator and the refrigerant branched between the first expansion device and the second expansion device and injected into the compressor;

an injection valve for adjusting the amount of refrigerant branched between the first expansion device and the second expansion device and injected into the compressor; and a control unit for controlling the first and second expansion devices and the injection valve, wherein, upon starting up the compressor, the control unit decreases the opening degree of at least one of the first and second expansion devices, and then increases the same based on the start-up of the compressor, and upon completion of the start-up of the compressor, the control unit controls the opening amount of the first expansion device in an intermediate pressure control method for adjusting the intermediate pressure of refrigerant and controls the opening amount of the second expansion device in a superheat degree control method for adjusting the degree of superheat of refrigerant.

* * * * *